US005477617A

United States Patent [19]

Guy

[11] Patent Number: 5,477,617

[45] Date of Patent: Dec. 26, 1995

[54] CARPET MEASUREMENT TOOL

[76] Inventor: John W. Guy, Rte. 1, Box 237, Midway, Ark. 72651

[21] Appl. No.: 355,527

[22] Filed: Dec. 14, 1994

[51] Int. Cl.[6] ..... G06C 3/00; G06G 1/16

[52] U.S. Cl. ..... 33/15 B; 33/1 B; 33/121

[58] Field of Search ..... 33/1 SB, 1 B, 33/16, 121, 122, 526, 527, 1 AA, 1 C, 494

[56] References Cited

U.S. PATENT DOCUMENTS

| | | | |
|---|---|---|---|
| 652,722 | 6/1900 | Mitchell | 33/494 |
| 2,747,795 | 5/1956 | Kreuttner | 33/1 B |
| 4,659,409 | 4/1987 | Arafat | 33/527 |
| 4,827,621 | 5/1989 | Borsuk | 33/1 B |

*Primary Examiner*—Christopher W. Fulton

[57] ABSTRACT

A carpet measurement tool comprising a rigid rectangular plate having an upper surface, a lower surface, a pair of opposed long edges, and a pair of short edges extended therebetween; a distance ruler with a set length and scaling disposed on the upper surface of the plate near one long edge, the distance ruler a plurality of equally spaced tick marks disposed thereon; a composite ruler having a scaling equal to the distance ruler and disposed near the other long edge, the composite ruler including a plurality of sub-rulers positioned in a stacked relation, each sub-ruler aligned with the distance ruler, each sub-ruler having tick marks disposed thereon to thereby create a plurality of measuring bars with the measuring bars of each sub-ruler corresponding to a characteristic carpet type having a given breadth; and a set of columns disposed between the distance ruler and the composite ruler, each column having a scaling equal to the distance ruler and composite ruler, each column identifying a characteristic carpet type and breadth, each column bearing a sequence of numbers thereon and with each number representing an areal dimension of a characteristic carpet type and breadth as cross-correlated to a measured distance as provided from the distance ruler.

7 Claims, 5 Drawing Sheets

CARPET MEASUREMENT TOOL

BACKGROUND OF THE INVENTION

1. Field of the Invention

The present invention relates to a carpet measurement tool and more particularly pertains to allowing a user to measure distances on a floor plan and correlate these measured distances directly with carpet type, breadth, and yardage with a carpet measurement tool.

2. Description of the Prior Art

The use of measurement tools is known in the prior art. More specifically, measurement tools heretofore devised and utilized for the purpose of measuring carpet are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No.260,005 to Sandfield discloses a ruler. U.S. Pat. Des. No. 314,722 to Silver discloses a measuring stick. U.S. Pat. No. 3,937,118 to Leonard discloses an inversion slide rule. U.S. Pat. No. 4,538,055 to Riehle discloses a slide rule. U.S. Pat. No. 5,174,036 to Lin discloses a multi-functional ruler.

While these devices fulfill their respective, particular objective and requirements, the aforementioned patents do not describe a carpet measurement tool that allows a ready determination of areal dimensions of a characteristic carpet type required to cover a given area.

In this respect, the carpet measurement tool according to the present invention substantially departs from the conventional concepts and designs of the prior art, and in doing so provides an apparatus primarily developed for the purpose of allowing a user to measure distances on a floor plan and correlate these measured distances directly with carpet type, breadth, and yardage.

Therefore, it can be appreciated that there exists a continuing need for a new and improved carpet measurement tool which can be used for allowing a user to measure distances on a floor plan and correlate these measured distances directly with carpet type, breadth, and yardage. In this regard, the present invention substantially fulfills this need.

SUMMARY OF THE INVENTION

In the view of the foregoing disadvantages inherent in the known types of measurement tools now present in the prior art, the present invention provides an improved carpet measurement tool. As such, the general purpose of the present invention, which will be described subsequently in greater detail, is to provide a new and improved carpet measurement tool and method which has all the advantages of the prior art and none of the disadvantages.

To attain this, the present invention essentially comprises, in combination, a rigid rectangular plate having an upper surface, a lower surface, a periphery interconnecting the upper surface with the periphery formed of a short top edge, a short bottom edge, a long left edge, and a long right edge. The upper surface further includes a left section, a right section, and an intermediate section therebetween.

The right section has a distance ruler with a set length disposed thereon. The distance ruler is extended from the bottom edge to near the top edge at a location adjacent to the right edge. The distance ruler has fifty-four equally spaced primary tick marks disposed thereon. The first fifty-three primary tick marks bear reference numbers from "1" to "53", respectively. The last primary tick mark remains unnumbered. The spacing between consecutive primary tick marks is ¼ inch. The distance ruler further includes a plurality of equally spaced secondary tick marks thereon. Each secondary tick mark is centrally disposed between a pair of primary tick marks. Each primary tick mark represents a true distance of 1 foot. Each secondary tick mark represents a true distance of ½ foot. The distance ruler thus has a scaling wherein a measured distance of ¼ inch thereon represents a true distance of 1 foot.

The left section has a composite ruler disposed thereon. The composite ruler is extended from near the top edge to the bottom edge at a location adjacent to the left edge. The composite ruler includes a first, a second, a third, and a fourth sub-ruler positioned in a stacked relation. Each sub-ruler is aligned with and has the same scaling and length as the distance ruler. Each sub-ruler additionally has a heading section followed by a measurement section. The heading section of the first sub-ruler bears a label of "¾" for indicating a first carpet type having a breadth of 27 inches. The measurement section of the first sub-ruler has a plurality of equally spaced tick marks disposed thereon to thereby create a first set of twenty-four measuring bars. The measuring bars of the first set bear identification numbers from "1" to "24", respectively. Each measuring bar of the first set represents a true distance of 27 inches. The heading section of the second sub-ruler bears the label of "9" for indicating a second carpet type having a breadth of 9 feet. The measurement section of the second sub-ruler has a plurality of equally spaced tick marks disposed thereon to thereby create a second set of six measuring bars. Each measuring bar of the second set bears a label of "9 foot" and represents a true distance of 9feet. The heading section of the third sub-ruler bears a label of "12" for indicating a third carpet type having a breadth of 12 feet. The measurement section of the third sub-ruler has a plurality of equally spaced tick marks disposed thereon to thereby create a third set of four measuring bars. Each measuring bar of the third set bears a label of "12 foot" and represents a true distance of 12 feet. The heading section of the fourth sub-ruler bears a label of "15" for indicating a fourth carpet type having a breadth of 15 feet. The measurement section of the fourth sub-ruler has a plurality of tick marks disposed thereon to thereby create a fourth set of three measuring bars. Each measuring bar of the fourth set bears a label of "15 foot" and represents a true distance of 15 feet.

The intermediate section has a first major column, a second major column, a third major column, and a fourth major column with a first tick mark column located between the first and second major columns, a second tick mark column located between the second and third major columns, and a third tick mark column located between the third major column and the fourth major column. Each tick mark column has the same scaling as the distance ruler and the composite ruler and is aligned therewith. Each tick mark column bears a plurality of equally spaced tick marks thereon for measuring a distance corresponding with the distance ruler and the composite ruler. The spacing between the tick marks represents a true distance of ½ foot. Each major column further has an upper end located near the top edge and a lower end located at the lower edge. Each major column includes a heading section and a measurement section with each measurement section having the same scaling as the distance ruler and the measurement sections of the composite ruler and is aligned therewith. Each measurement section of each major column further has a plurality of equally spaced tick marks disposed thereon to thereby create a set of 18 measuring spaces. Each measuring space represents a true distance of 3 feet. The heading section of each major column has an upper portion and a lower portion. The lower portion of the first, second, and third major columns is divided into two equally sized parts. The lower portion of the fourth major column is divided into six equally sized parts. The upper portion of the heading section of the first major column bears a label of "15 foot" for indicating the first carpet type. The upper portion of the heading section of the second major column bears a label of "12 foot" for indicating the second carpet type. The upper portion of the heading section of the third major column bears a label of "9 foot" for indicating the third carpet type. The upper portion of the heading section of the fourth major column bears the label of "¾ carpet" for indicating the fourth carpet type. The two parts of the heading sections of the first, second, and third major columns bear the labels of "BREADTH 2" and "BREADTH 1", respectively. Each label indicates a number of breadths of the corresponding carpet type. The six parts of the heading section of the fourth major column bear the labels of "BREADTH 6" through "BREADTH 1", respectively. Each label indicates a number of breadths of the fourth carpet type. Each measurement section of the first, the second, and the third major columns is divided into two equally sized minor columns. Each minor column of the first, second, and third major columns bears a sequence of numbers thereon and with each number representing a number of square yards of the corresponding carpet type based upon a given breadth thereof cross-correlated with a measured distance provided from the distance ruler. The measurement section of the fourth major column is divided into six equally sized minor columns. Each minor column of the fourth major column bears a sequence of numbers theron and with each number representing a number of lineal yards of the fourth carpet type cross-correlated to a measured distance as provided from the distance ruler.

A rigid rectangular backing is included and has a length and width equal to that of the plate. The backing further includes a top surface, a bottom surface, a periphery interconnecting the top surface with the bottom surface formed a short top edge, a short bottom edge, and opposed long side edges. Also included is a pair of slots with each slot formed on a side edge and extended to the top surface. A layer of adhesive interconnects the lower surface of the plate to the top surface of the backing such that the backing and plate are aligned and thereby create a pair of opposed grooves below the long edges of the plate. Lastly, a rigid transparent elongated slider gauge is provided. The slider gauge has a central section disposed above the upper surface of the plate and a pair of integral end arms slidably secured within the grooves. The slider gauge further includes a plurality of tick marks thereon for facilitating a determination of a number of yards of carpet based on a distance measured with the distance ruler as cross-correlated with a carpet type and breadth.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved carpet measurement tool which has all the advantages of the prior art measurement tools and none of the disadvantages.

It is another object of the present invention to provide a new and improved carpet measurement tool which may be easily and efficiently manufactured and marketed.

It is a further object of the present invention to provide a new and improved carpet measurement tool which is of durable and reliable construction.

An even further object of the present invention is to provide a new and improved carpet measurement tool which is susceptible of a low cost of manufacture with regard to both materials and labor, and which accordingly is then susceptible of low prices of sale to the consuming public, thereby making such a carpet measurement tool economically available to the buying public.

Still yet another object of the present invention is to provide a new and improved carpet measurement tool which provides in the apparatuses and methods of the prior art some of the advantages thereof, while simultaneously overcoming some of the disadvantages normally associated therewith.

Even still another object of the present invention is to provide a new and improved carpet measurement tool comprising a rigid rectangular plate having an upper surface, a lower surface, a pair of opposed long edges, and a pair of short edges extended therebetween; a distance ruler with a set length and scaling disposed on the upper surface of the plate near one long edge, the distance ruler a plurality of equally spaced tick marks disposed thereon; a composite ruler having a scaling equal to the distance ruler and disposed near the other long edge, the composite ruler including a plurality of sub-rulers positioned in a stacked relation, each sub-ruler aligned with the distance ruler, each sub-ruler having tick marks disposed thereon to thereby create a plurality of measuring bars with the measuring bars of each sub-ruler corresponding to a characteristic carpet type having a given breadth; and a set of columns disposed between the distance ruler and the composite ruler, each column having a scaling equal to the distance ruler and composite ruler, each column identifying a characteristic carpet type and breadth, each column bearing a sequence of numbers thereon and with each number representing an areal dimension of a characteristic carpet type and breadth as cross-correlated to a measured distance as provided from the distance ruler.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
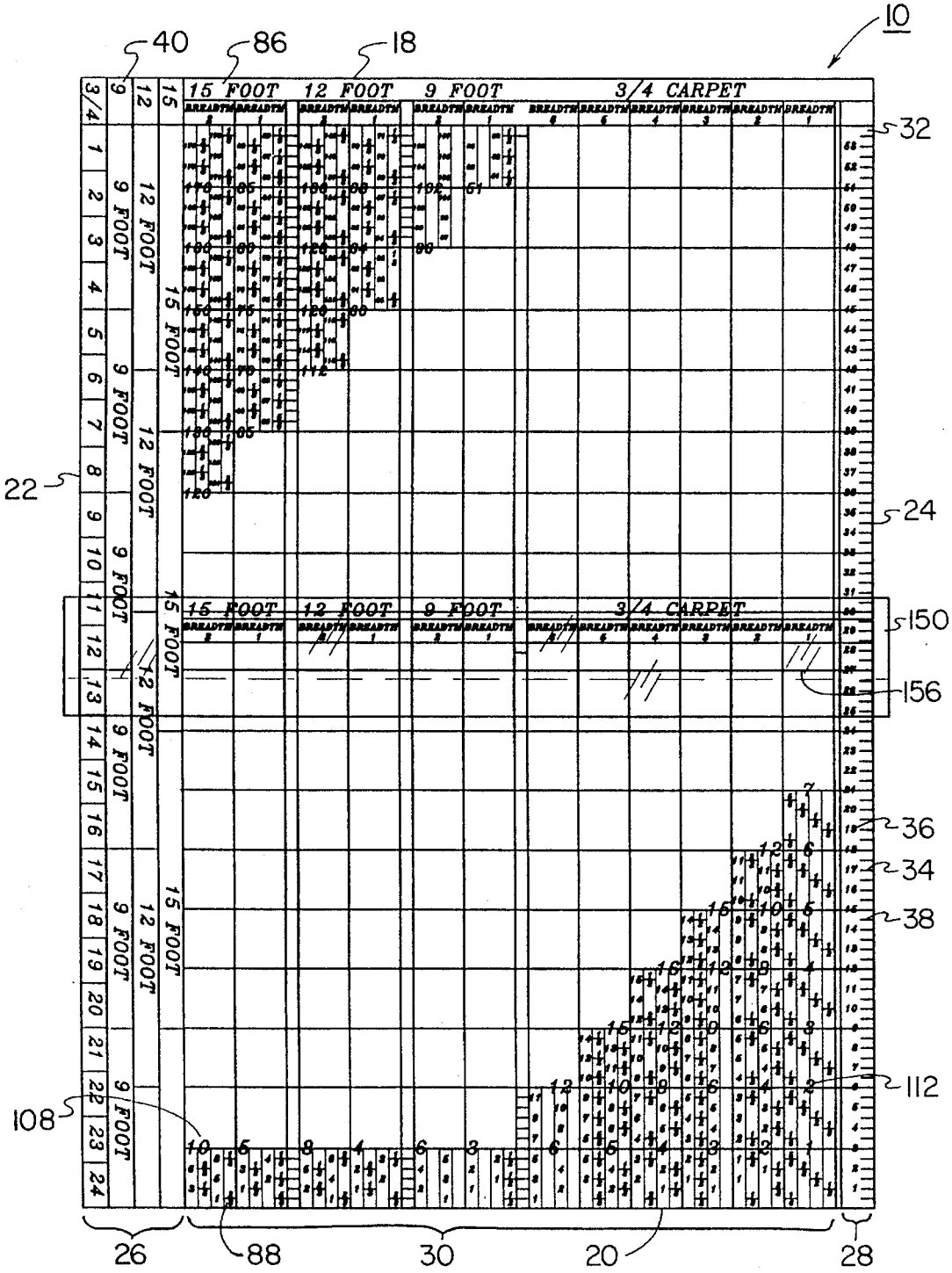
FIG. 1 is a plan view of the preferred embodiment constructed in accordance with the principles of the present invention.
Figure 2:
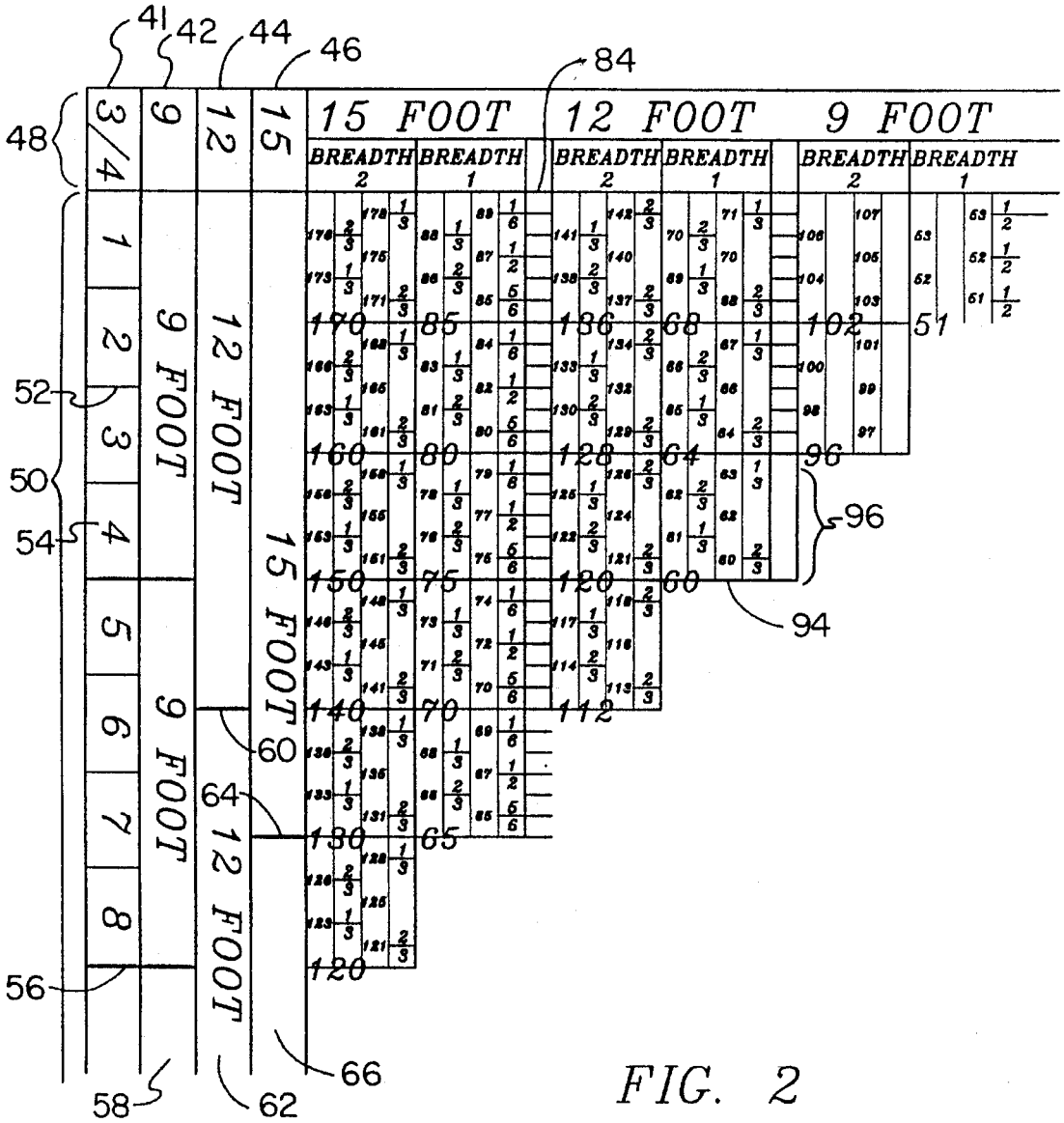
FIG. 2 is an enlarged plan view of the upper left corner of the present invention.
Figure 3:
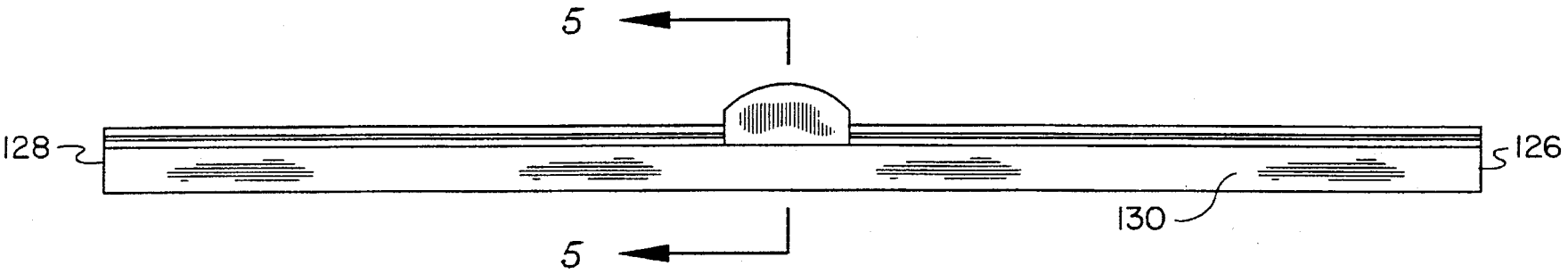
FIG. 3 is a side elevational view of the present invention depicting the relation of the slider gauge with the upper surface of the plate.
Figure 4:
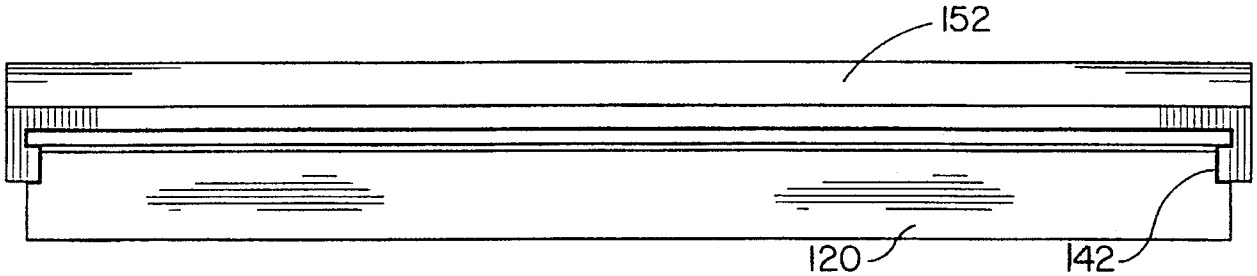
FIG. 4 is yet another side elevational view of the present invention depicting the relation of the slider gauge with the upper surface of the plate.
Figure 5:
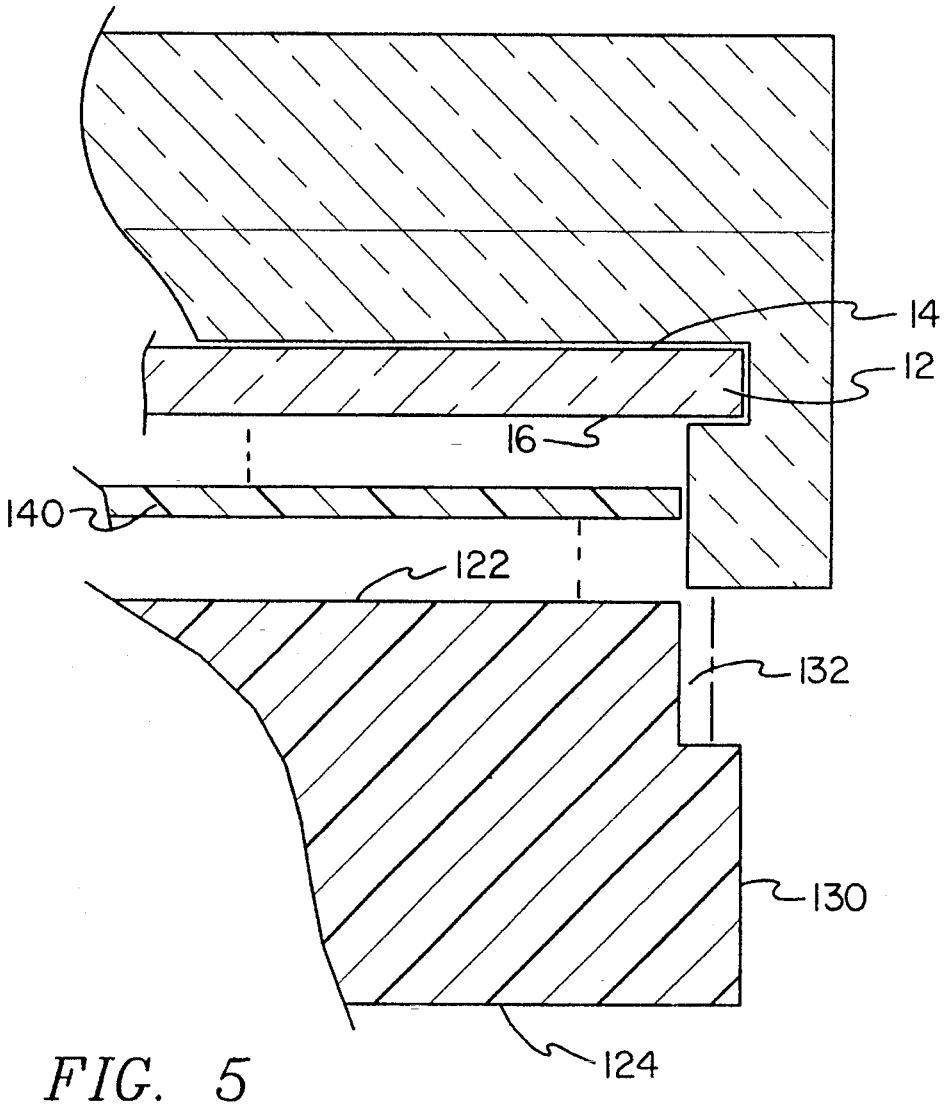
FIG. 5 is an exploded cross-sectional view of the present invention taken along the line 5—5 of FIG. 3.
Figure 6:
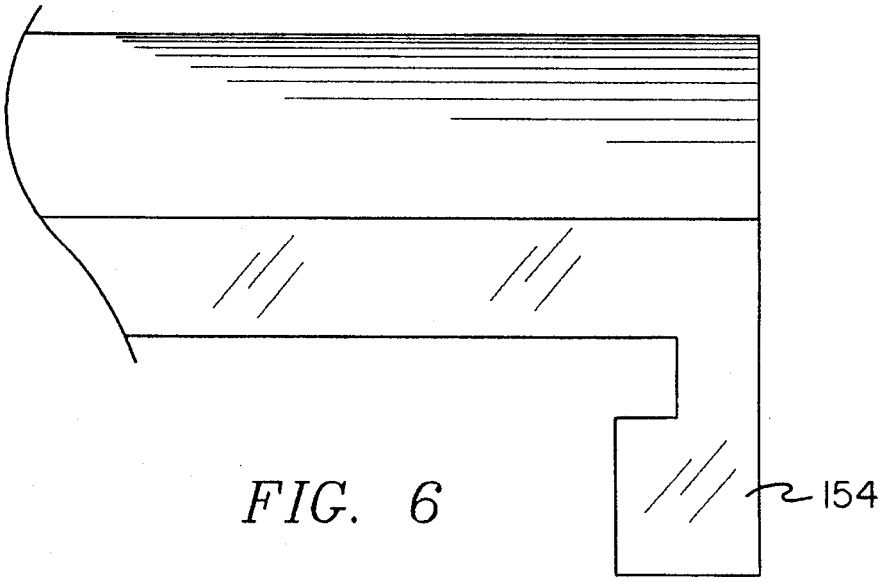
FIG. 6 is an enlarged view of an end of the measurement slider.
Figure 7:
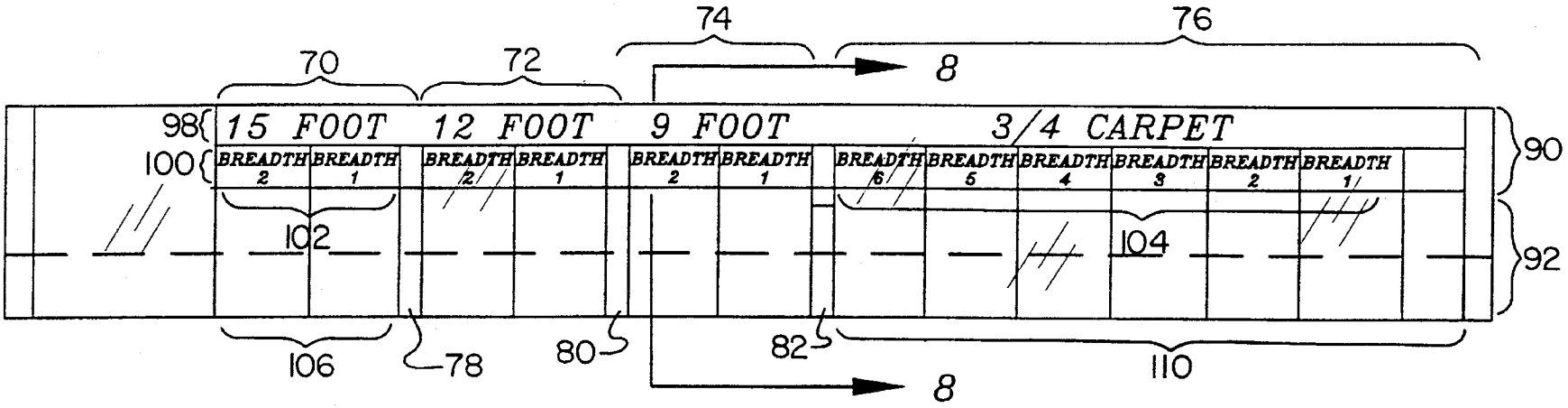
FIG. 7 is an enlarged plan view of the top edge of the present invention.
Figure 8:
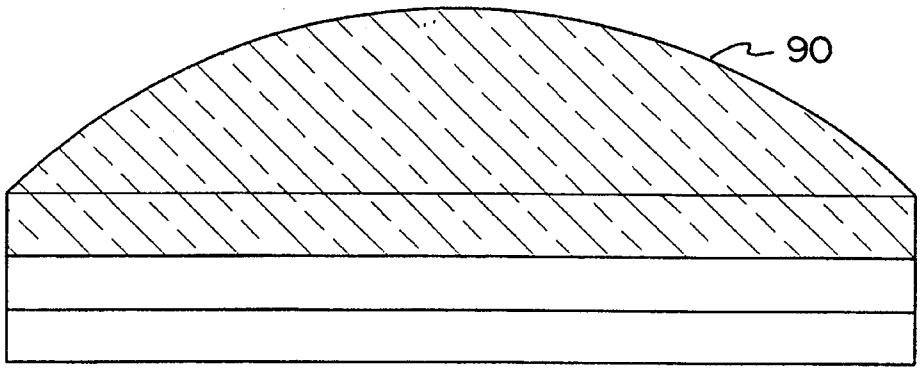
FIG. 8 is a cross-sectional view of the present invention taken along the line 8—8 of FIG. 7.

With reference now to the drawings, and in particular, to FIG. 1 thereof, the preferred embodiment of the new and improved carpet measurement tool embodying the principles and concepts of the present invention and generally designated by the reference number 10 will be described.

The present invention is comprised of a plurality of components. In their broadest context, such components include a graduated plate with indica disposed thereon and a slider gauge. Such components are individually configured and correlated with respect to each other to provide the intended function of allowing a user to measure distances on a floor plan and correlate these measured distances directly with a carpet type, breadth and length, and corresponding yardage.

The present invention includes a plate 12. The plate is rectangular and planar in structure. The plate is formed of metal, plastic, or other rigid material. The plate has an upper surface 14, a lower surface 16, and a periphery interconnecting the upper surface with the lower surface. The periphery is formed of a short top edge 18, a short bottom edge 20, a long left edge 22, and a long right edge 24. The upper surface is further partitioned into a left section 26, a right section 28, and an intermediate section 30 therebetween. The sections are bounded by an upper left corner, an upper right corner, a lower left corner and a lower right corner.

The right section has a distance ruler 32 disposed thereon. The distance ruler has a set length and is extended from the bottom edge to near the top edge of the plate. Furthermore, it is located adjacent to the right edge of the plate. The distance ruler is graduated with fifty-four equally spaced primary tick marks 34 disposed thereon. The first fifty-three primary tick marks bear reference numbers from "1" to "53", respectively. The last primary tick mark of the distance ruler is unnumbered. The distance ruler further has a plurality of equally spaced secondary tick marks 38 thereon. Each secondary tick mark is centrally disposed between a pair of primary tick marks. The spacing between consecutive primary tick marks is ¼ inch. Each primary tick mark represents a true distance of one foot. Each secondary tick mark represents a true distance of ½ foot. The distance ruler thus has a scaling wherein a measured distance of ¼ inch represents a true distance of one foot. With this scaling, the distance ruler is set to be utilized for measuring distances on floor plans having a scaling where ¼ inch equals one foot.

The left section of the plate has a composite ruler 40 disposed thereon. The composite ruler is extended from near the top edge to near the bottom edge of the plate. Furthermore, it is located adjacent to the left edge of the plate. The composite ruler is graduated and divided a first sub-ruler 41, a second sub-ruler 42, a third sub-ruler 44, and a fourth sub-ruler 46. The sub-rulers are positioned in a stacked oriented relation. Each sub-ruler is aligned lengthwise and crosswise with the other sub-rulers and distance ruler. Each sub-ruler also has the same scaling and length as the distance ruler 32, whereby they both measure over the same scaled distance of 54 feet. Each sub-ruler additionally has a heading section 48 followed immediately by an elongated measurement section 50. Each heading section is rectangular in shape. The heading section of the first sub-ruler bears the label of "¾" for indicating a commercially available first carpet type having a breadth of 27 inches. Note that since carpets are usually supplied in rolls that can have varying degrees of length, a given carpet is usually referred to generically by its breadth. The "¾" designation as utilized here represents a standard nomenclature in the carpet industry wherein a carpet having a breadth of 9 inches is designated as a "¼". Therefore, a carpet having a breadth of 27 inches is designated as "¾". The measurement section of the first sub-ruler has a plurality of equally spaced tick marks 52 disposed thereon. These tick marks create a first set of twenty-four measuring bars 54 positioned in an end-to-end relation. Each measuring bar is rectangular in shape. The measuring bars of the first set bear identification numbers from "1" to "24", respectively. The twenty-four measuring bars are located adjacent to the left edge. The scaled distance of each measuring bar of the first sub-ruler represents a true distance or carpet breadth of 27 inches.

The heading section of the second sub-ruler bears the label of "9" for indicating a commercially available second carpet type having a breadth of 9 feet. The measurement section of the second sub-ruler has a plurality of equally spaced tick marks 56 disposed thereon. These tick marks create a second set of six measuring bars 58 positioned in an end-to-end relation. Each measuring bar is rectangular in shape. Each measuring bar of the second set bears a label of "9 foot". The scaled distance of each measuring bar of the second sub-ruler represents a true distance or carpet breadth of 9 feet.

The heading section of the third sub-ruler bears a label of "12" for indicating a commercially available third carpet type having a breadth of 12 feet. The measurement section of the third sub-ruler has a plurality of equally spaced tick marks 60 disposed thereon. These tick marks create a third set of four measuring bars 62 positioned in an end-to-end relation. Each measuring bar is rectangular in shape. Each measuring bar of the third set bears a label of "12 foot" and represents a true distance or carpet breadth of 12 feet.

The heading section of the fourth sub-ruler bears a label of "15" for indicating a commercially available carpet type having a breadth of 15 feet. The measurement section thereof has a plurality of tick marks 64 disposed thereon. These tick marks create a fourth set of three measuring bars 66 positioned in an end-to-end relation. Each measuring bar is rectangular in shape. Each measuring bar of the fourth set bears a label of "15 foot" and represents a true distance or carpet breadth of 15 feet.

The intermediate section of the plate is divided into a first major column 70, a second major column 72, a third major column 74, and a fourth major column 76. Also provided is a first tick mark column 78 located between the first and second major columns, a second tick mark column 80 located between the second and third major columns, and a third tick mark column 82 located between the third major column and the fourth major column. Each tick mark column has the same scaling as the distance ruler 32 and the composite ruler 40. Each tick mark column is aligned in parallel with the distance ruler and the composite ruler such that they measure over the same scaled distance of 54 feet. Each tick mark column bears a plurality of equally spaced tick marks 84 thereon. The tick marks are used for measuring a distance corresponding with the distance ruler 32 and the composite ruler 40. The spacing between the tick marks represents a true distance of ½ foot. The tick mark columns are used in conjunction with the major columns and rulers for obtaining precise measurements.

Each major column also includes an upper end 86 located near the top edge of the plate and a lower end 88 located at the bottom edge of the plate. Each major column also includes a heading section 90 located near the top edge and measurement section 92 located therebelow. The heading section is used for identifying commercially available carpet types and corresponding adjacently positioned breadths thereof. Each measurement section has the same scaling and length as the distance ruler 32 and the measurement sections 50 of the composite ruler 40. Each measurement section of a major column is aligned lengthwise and crosswise with the distance ruler 32 and measurement sections 50 of the composite ruler and measure over the same scaled distance of 54 feet. Each heading section also extends upwardly from the upper surface of the plate and has a crescent-shaped cross-section for facilitating its viewing. Each measurement section of each major column further has a plurality of equally spaced tick marks 94 disposed thereon. These tick marks create a set of eighteen scaled measuring spaces 96. Each measuring space of a major column represents a true distance of 3 feet. The heading section of each major column has an upper portion 98 and a lower portion 100. The lower portion of the first major column 70, the second major column 72, and the third major column 74 are divided into two equally sized parts 102. The lower portion of the fourth column is divided into six equally sized parts 104. The upper portion of the heading section of the first major column bears the label of "15 foot". This label indicates the width or breadth of the first carpet type. The upper portion of the heading section of the second major column bears a label of "12 foot". This heading indicates the width or breadth of the second carpet type. The upper portion of the heading section of the third major column bears a label of "9 foot". This heading indicates the width or breadth of the third carpet type. Lastly, the upper portion of the heading section of the fourth major column bears the label of "¾ carpet" for indicating the width or breadth of the fourth carpet type. The two parts of the heading sections of the first major column 70, the second major column 72, and the third major column 74 bear the labels of "BREADTH 2" and "BREADTH 1", respectively. Each of these labels indicates a number of adjacently positioned and crosswise aligned breadths of the first, second, or third carpet type, respectively. The six parts of the heading section of the fourth major column bears the labels of "BREADTH 6" through "BREADTH 1", respectively. Each of these labels indicates a number of adjacently positioned and crosswise aligned breadths of the fourth carpet type. Each measurement section of the first major column, the second major column, and the third major column are divided into two equally sized minor columns 106. Each minor column bears a sequence of numbers 108 thereon in an alternating type relation. These numbers are extended from the top of each measurement section to the bottom of each measurement section. Each number represents a number of square yards of the corresponding carpet type based upon a given breadth thereof cross-correlated with a measured distance as provided from the distance ruler. The measurement section of the fourth major column is divided into six equally sized minor columns 110. Each minor column bears a sequence of numbers 112 disposed thereon in an alternating type relation. These numbers are extended from the top of the measuring section to the bottom of the measuring section. Each of these numbers represents a number of lineal yards of the fourth carpet type cross-correlated to a measured distance as provided from the distance ruler 32.

A backing 120 is also provided. The backing is rigid and rectangular in structure. It is formed of plastic, metal, or other such material. The backing has a length and a width equal to that of the plate. The backing further has a top surface 122, a bottom surface 124, and a periphery interconnecting the top surface with the bottom surface. The periphery is formed of a short top edge 126, a short bottom edge 128, and opposed long side edges 130. Also included is a pair of slots 132 formed on the side edges of the backing and extended to the top surface thereof.

To couple the backing to the plate, a layer of adhesive 140 is used. The layer of adhesive is disposed between the plate and backing such that the bottom surface of the plate is interconnected with the top surface of the backing. The backing and the plate are aligned to create a pair of opposed grooves 142. These grooves are located directly below the long edges of the plate.

A rigid transparent and elongated slider gauge 150 is also provided. The slider gauge has a rectangular central section 152 disposed just above the upper surface of the plate. The gauge also has a pair of integral end arms 154 slidably secured within the grooves 142. Each end arm has a generally C-shaped cross-section. The slider gauge further has a plurality of longitudinal tick marks 156 disposed thereon. The tick marks are used for facilitating a determination of a number of yards of carpet based on a distance measured with the distance ruler as cross-correlated with a carpet type and breadth.

An example of use of the present invention is now provided. Say a standard conventional floor plan having a scaling of ¼ inch equals 1 foot is provided to a user. The floor plan depicts a room having a dimension of 9 feet by 6 feet. Also known by the user is the type of carpet to be utilized, which, for this example, is of the "¾" carpet type. To determine the number of breadths of carpet required, the composite ruler is placed along the long dimension of the room, thereby facilitating in determining that four breadths of the "¾ carpet" are needed to cover the floor in this room. The length of the room shown on the floor plan may also be verified with the distance ruler to be 9 feet. Similarly, the distance rule may be used to measure unknown room dimensions. Now, knowing that the length of the room is 6 feet, the slider gauge is then positioned such that a tick mark thereof is aligned with the tick mark indicating six feet on the distance ruler. Looking at the column labeled "¾" under the heading of "BREADTH 4", it can now be seen that 8 lineal yards of carpet are required to cover the floor of the room. Thus, four breadths of "¾" type carpet are needed, thereby indicating that a total of 8 lineal yards are to be used. In a similar fashion, a user may utilize the present invention to gauge carpet type, length, and amount when there is overhang into an adjacent room or when an extension of carpet is needed like that in a closet. A similar procedure is followed in determining square yardage of carpet needed as determined through use of the first, second, or third major columns.

The present invention serves to measure distances on floor plans and display tabulations on areas as related to carpet widths, for various purposes, including estimating costs. The present invention is graduated along the right edge to a scale of ¼ inch equals 1 foot, in ½ foot increments, ranging from 0–54 feet. There are four basic columns of figures, under headings of 15 foot, 12 foot, 9 foot, and ¾ foot, corresponding to the standard widths of carpeting. Two columns are shown under each of the full size carpets, showing the data for a single carpet, and two carpets, however, the ¾ heading has six columns, one through six units. Along the left side of the display are increments that show the area covered by individual widths. The unit is accompanied by a clear plastic drafting t-square to assist in reading the plans and determining how many linear feet of each width of carpeting is required for a room or other area.

The present invention enables a contractor to work directly from floor plans to determine the carpeting needs. No measurements are need, no dimensions must be found on the plans because it scales the plans and indicates the total area required and the linear feet for each width of carpeting.

The present invention could also be formed in enlarged or smaller scaled or unscaled sizes and other carpet types, with multiplication or division used to convert to other scales, such as ⅛ and ½ inch per foot.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A carpet measurement tool for allowing a user to measure distances on a floor plan and correlate these measured distances directly with carpet type, breadth, and yardage comprising, in combination:

a rigid rectangular plate having an upper surface, a lower surface, a periphery interconnecting the upper surface with the periphery formed of a short top edge, a short bottom edge, a long left edge, and a long right edge, the upper surface further having a left section, a right section, and an intermediate section therebetween;

the right section having a distance ruler with a set length disposed thereon and extended from the bottom edge to near the top edge at a location adjacent to the right edge, the distance ruler having fifty-four equally spaced primary tick marks disposed thereon, the first fifty-three primary tick marks bearing reference numbers from "1" to "53", respectively, with the last primary tick mark remaining unnumbered and with the spacing between consecutive primary tick marks being ¼ inch, the distance ruler further having a plurality of equally spaced secondary tick marks thereon with each secondary tick mark centrally disposed between a pair of primary tick marks, each primary tick mark representing a true distance of 1 foot, each secondary tick mark representing a true distance of ½ foot, the distance ruler thus having a scaling wherein a measured distance of ¼ inch thereon represents a true distance of 1 foot, the left section having a composite ruler disposed thereon and extended from near the top edge to the bottom edge at a location adjacent to the left edge, the composite ruler including a first, a second, a third, and a fourth sub-ruler positioned in a stacked relation, each sub-ruler aligned with and having the same scaling and length as the distance ruler, each sub-ruler additionally having a heading section followed by a measurement section, the heading section of the first sub-ruler bearing a label of "¾" for indicating a first carpet type having a breadth of 27 inches and with the measurement section thereof having a plurality of equally spaced tick marks disposed thereon to thereby create a first set of twenty-four measuring bars, the measuring bars of the first set bearing identification numbers from "1" to "24", respectively, and with each measuring bar of the first set representing a true distance of 27 inches, the heading section of the second sub-ruler bearing the label of "9" for indicating a second carpet type having a breadth of 9 feet and with the measurement section thereof having a plurality of equally spaced tick marks disposed thereon to thereby create a second set of six measuring bars, each measuring bar of the second set bearing a label of "9 foot" and representing a true distance of 9 feet, the heading section of the third sub-ruler bearing a label of "12" for indicating a third carpet type having a breadth of 12 feet and with the measurement section thereof having a plurality of equally spaced tick marks disposed thereon to thereby create a third set of four measuring bars, each measuring bar of the third set bearing a label of "12 foot" and representing a true distance of 12 feet, the heading section of the fourth sub-ruler bearing a label of "15" for indicating a fourth carpet type having a breadth of 15 feet and with the measurement section thereof having a plurality of tick marks disposed thereon to thereby create a fourth set of three measuring bars, each measuring bar of the fourth set bearing a label of "15 foot" and representing a true distance of 15 feet, the intermediate section having a first major column, a second major column, a third major column, and a fourth major column with a first tick mark column located between the first and second major columns, a second tick mark column located between the second and third major columns, and a third tick mark column located between the third major column and the fourth major column, each tick mark column having the same scaling as the distance ruler and the composite ruler and aligned therewith, each tick mark column bearing a plurality of equally spaced tick marks thereon for measuring a distance corresponding with the distance ruler and the composite ruler and with the spacing between the tick marks representing a true distance of ½ foot, each major column further having an upper end located near the top edge and a lower end located at the lower edge, each major column including a heading section and a measurement section with each measurement section having the same scaling as the distance ruler and the measurement sections of the composite ruler and aligned therewith, each measurement section of each major column further having a plurality of equally spaced tick marks disposed thereon to thereby create a set of 18 measuring spaces and with each measuring space representing a true distance of 3 feet, the heading section of each major column having an upper portion and a lower portion with the lower portion of the first, second, and third major columns divided into two equally sized parts and with the lower portion of the fourth major column divided into six equally sized parts, the upper portion of the heading section of the first major column bearing a label of "15 foot" for indicating the first carpet type, the upper portion of the heading section of the second major column bearing a label of "12 foot" for indicating the second carpet type, the upper portion of the heading section of the third major column bearing a label of "9 foot" for indicating the third carpet type, and the upper portion of the heading section of the fourth major column bearing the label of "¾ carpet" for indicating the fourth carpet type, the two parts of the heading sections of the first, second, and third major columns bearing the labels of "BREADTH 2" and "BREADTH 1", respectively, with each label indicating a number of breadths of the corresponding carpet type, the six parts of the heading section of the fourth major column bearing the labels of "BREADTH 6" through "BREADTH 1", respectively, with each label indicating a number of breadths of the fourth carpet type, each measurement section of the first, the second, and the third major columns divided into two equally sized minor columns with each minor column bearing a sequence of numbers thereon and with each number representing a number of square yards of the corresponding carpet type based upon a given breadth thereof cross-correlated with a measured distance provided from the distance ruler, the measurement section of the fourth major column divided into six equally sized minor columns with each minor column bearing a sequence of numbers theron and with each number representing a number of lineal yards of the fourth carpet type cross-correlated to a measured distance as provided from the distance ruler;

a rigid rectangular backing having a length and width equal to that of the plate, the backing further having a top surface, a bottom surface, a periphery interconnecting the top surface with the bottom surface formed a short top edge, a short bottom edge, and opposed long side edges, the back additionally including a pair of slots with each slot formed along a side edge and extended upwards to the top surface;

a layer of adhesive interconnecting the lower surface of the plate to the top surface of the backing and with the backing and plate in alignment to thereby create a pair of opposed grooves below the long edges of the plate; and a rigid transparent elongated slider gauge having a central section disposed above the upper surface of the plate and a pair of integral end arms slidably secured within the grooves, the slider gauge further having a plurality of tick marks thereon for facilitating a determination of a number of yards of carpet based on a distance measured with the distance ruler as cross-correlated with a carpet type and breadth.

2. A carpet measurement tool comprising:

a rigid rectangular plate having an upper surface, a lower surface, a pair of opposed long edges, and a pair of short edges extended therebetween, a distance ruler with a set length and scaling disposed on the upper surface of the plate near one long edge, the distance ruler having a plurality of equally spaced tick marks disposed thereon;

a composite ruler having a scaling equal to the distance ruler and disposed near the other long edge, the composite ruler including a plurality of sub-rulers positioned in a stacked relation, each sub-ruler aligned with the distance ruler, each sub-ruler having tick marks disposed thereon to thereby create a plurality of measuring bars with the measuring bars of each sub-ruler corresponding to a characteristic carpet type having a given breadth; and a set of columns disposed between the distance ruler and the composite ruler, each column having a scaling equal to the distance ruler and composite ruler, each column identifying a characteristic carpet type and breadth, each column bearing a sequence of numbers thereon and with each number representing an areal dimension of a characteristic carpet type and breadth as cross-correlated to a measured distance as provided from the distance ruler.

3. The carpet measuring tool as set forth in claim 2 wherein the distance ruler includes reference numerals disposed thereon near the tick marks for facilitating in measuring distances.

4. The carpet measuring tool as set forth in claim 2 wherein each sub-ruler bears a label thereon for identifying the characteristic carpet type.

5. The carpet measuring tool as set forth in claim 2 wherein each column bears labels for identifying the characteristic carpet type and the corresponding number of breadths of the characteristic carpet type.

6. The carpet measuring tool as set forth in claim 2 further including a rigid rectangular backing coupled to the lower surface of the plate.

7. The carpet measuring tool as set forth in claim 2 further including a slider gauge slidably coupled to the plate and extended over the upper surface thereof for facilitating a determination of an areal dimension based on a distance measured with the distance ruler as cross-correlated with the characteristic carpet type and breadth.

* * * * *